US008673838B2

(12) United States Patent
Christensen et al.

(10) Patent No.: US 8,673,838 B2
(45) Date of Patent: Mar. 18, 2014

(54) SOLID CONCENTRATED FABRIC SOFTENER COMPOSITION

(75) Inventors: Stephen B. Christensen, Inver Grove Heights, MN (US); Joanna A. Pham, Blaine, MN (US); Jessica Rose Carlson, White Bear Lake, MN (US)

(73) Assignee: Ecolab USA Inc., Saint Paul, MN (US)

( * ) Notice: Subject to any disclaimer, the term of this patent is extended or adjusted under 35 U.S.C. 154(b) by 197 days.

(21) Appl. No.: 13/166,339

(22) Filed: Jun. 22, 2011

(65) Prior Publication Data

US 2012/0324652 A1 Dec. 27, 2012

(51) Int. Cl.
*C11D 1/86* (2006.01)

(52) U.S. Cl.
USPC ..... 510/515

(58) Field of Classification Search
USPC ..... 510/515
See application file for complete search history.

(56) References Cited

U.S. PATENT DOCUMENTS

| | | | | |
|---|---|---|---|---|
| 4,110,498 | A | 8/1978 | Benjamin et al. | |
| 4,134,838 | A | 1/1979 | Hooper et al. | |
| 4,196,104 | A | 4/1980 | Oguagha | |
| 5,039,659 | A | 8/1991 | Narula et al. | |
| 5,070,073 | A | 12/1991 | Narula et al. | |
| 5,116,520 | A | 5/1992 | Lichtenwalter et al. | |
| 5,221,794 | A | 6/1993 | Ackerman et al. | |
| 5,223,628 | A | 6/1993 | Whittlinger | |
| 5,234,611 | A | 8/1993 | Trinh et al. | |
| 5,403,499 | A | 4/1995 | Kiefer et al. | |
| 5,456,855 | A * | 10/1995 | De Cupere | 510/441 |
| 5,476,599 | A | 12/1995 | Rusche et al. | |
| 5,500,138 | A | 3/1996 | Bacon et al. | |
| 5,503,756 | A | 4/1996 | Corona, III et al. | |
| 5,536,421 | A | 7/1996 | Hartman et al. | |
| 5,562,847 | A | 10/1996 | Waite et al. | |
| 5,643,865 | A | 7/1997 | Mermelstein et al. | |
| 5,759,990 | A | 6/1998 | Wahl et al. | |
| 5,773,409 | A | 6/1998 | Haq et al. | |
| 5,777,046 | A | 7/1998 | Boeckh et al. | |
| 5,783,534 | A | 7/1998 | Wahle et al. | |
| 5,804,547 | A | 9/1998 | Godfroid et al. | |
| 6,037,315 | A | 3/2000 | Franklin et al. | |
| 6,093,336 | A | 7/2000 | Ploumen et al. | |
| 6,110,886 | A | 8/2000 | Scepanski | |
| 6,271,193 | B1 | 8/2001 | Sprecker et al. | |
| 6,531,444 | B1 | 3/2003 | Shefer et al. | |
| 6,825,163 | B1 | 11/2004 | Kvita et al. | |
| 2001/0021692 | A1 | 9/2001 | Mohammadi et al. | |
| 2002/0037825 | A1 | 3/2002 | Demeyere et al. | |
| 2002/0128170 | A1 | 9/2002 | DeClercq et al. | |
| 2003/0013632 | A1 | 1/2003 | Santos et al. | |
| 2003/0056301 | A1 * | 3/2003 | Dekker et al. | 8/158 |
| 2003/0068295 | A1 | 4/2003 | Rohde et al. | |
| 2003/0199420 | A1 | 10/2003 | Tsumori et al. | |
| 2003/0236181 | A1 | 12/2003 | Chan et al. | |
| 2004/0023838 | A1 | 2/2004 | Schramm, Jr. et al. | |
| 2004/0067866 | A1 | 4/2004 | Griese et al. | |
| 2004/0101505 | A1 | 5/2004 | Payne et al. | |
| 2004/0139990 | A1 | 7/2004 | Wachter et al. | |
| 2004/0167056 | A1 | 8/2004 | Lentsch et al. | |
| 2005/0020476 | A1 * | 1/2005 | Wahl et al. | 510/515 |
| 2005/0043208 | A1 * | 2/2005 | Bettiol et al. | 510/515 |
| 2005/0227907 | A1 | 10/2005 | Lee et al. | |
| 2006/0090777 | A1 * | 5/2006 | Hecht et al. | 134/42 |
| 2007/0054835 | A1 | 3/2007 | Corona, III et al. | |
| 2008/0253981 | A1 | 10/2008 | Lupia et al. | |
| 2011/0023240 | A1 * | 2/2011 | Fossum et al. | 8/137 |
| 2011/0028381 | A1 | 2/2011 | Sajic et al. | |

FOREIGN PATENT DOCUMENTS

| | | | |
|---|---|---|---|
| EP | 0535942 | B1 | 4/1993 |
| EP | 0535942 | B2 | 4/1993 |
| EP | 0580245 | A2 | 1/1994 |
| EP | 0679713 | A1 | 11/1995 |
| EP | 0912673 | B1 | 5/1999 |
| EP | 0920486 | B2 | 6/1999 |
| JP | 2001192967 | A | 7/2001 |
| WO | 9533038 | A1 | 12/1995 |
| WO | 9816538 | A1 | 4/1998 |
| WO | 9817756 | A1 | 4/1998 |
| WO | 9845394 | A2 | 10/1998 |
| WO | 9847991 | A1 | 10/1998 |
| WO | 9906509 | A1 | 2/1999 |
| WO | 011413 | A1 | 3/2001 |
| WO | 02081611 | A1 | 10/2002 |
| WO | 04000016 | A2 | 12/2003 |
| WO | 2007096790 | A1 | 8/2007 |

OTHER PUBLICATIONS

JP2001192967, Kao Corp—English Abstract.
Ecolab USA Inc. et al., PCT/IB2012/052923, "International Search Report and the Written Opinion of the International Searching Aauthority, or the Declaration", mail date Feb. 28, 2013.

* cited by examiner

*Primary Examiner* — John Hardee
(74) *Attorney, Agent, or Firm* — McKee, Voorhees & Sease, P.L.C.

(57) ABSTRACT

A solid fabric softening composition is disclosed which includes a quaternary ammonium fabric softening compound which is stabilized to form a solid with a mixture of a water soluble organic salt and a medium to long chain carboxylic acid. This stabilizing combination has been shown to effectively form a solid quaternary ammonium based fabric softening composition with up to as much as 70% by weight of quaternary ammonium compound. The formulations are stable at typical storage temperatures of up to 110° F. and provide fabric softening similar to and even superior to other traditional liquid formulations.

20 Claims, No Drawings

SOLID CONCENTRATED FABRIC SOFTENER COMPOSITION

FIELD OF THE INVENTION

This invention relates to a solid softener composition suitable for treatment of textile articles in domestic, institutional and/or industrial applications. The invention is also a method for softening textile articles using a solid softener composition.

BACKGROUND OF THE INVENTION

It is well known that textiles which have been washed, either in automatic or manual washing processes, and particularly those made of cellulose fibers, present a very unpleasant touch after drying. This undesired hardened feel can be overcome by treating the garments after washing in a rinsing bath with conditioning products. These conditioning compositions are generally liquid dispersions of cationic compounds that are delivered into the rinsing bath through a dispenser, in an automatic process, or directly, in a manual process. Fabric softener (i.e., conditioning) compositions are commonly used to deposit a fabric softening compound onto fabric. Typically, such compositions contain a cationic fabric softening agent dispersed in water. Fabric softener compositions used in the rinse cycle are generally separated into two basic product categories based on solids (active softening agent/fabric softening active) concentration. Compositions containing more than 10% by weight (e.g., 10-50% or 15-25% by weight) solids are often referred to as "concentrated" compositions, and compositions containing less than 10% by weight (e.g., 3-5% by weight) solids are often referred to as "diluted" compositions. Compositions containing softening agent below 5% by weight are sometimes called "ultra dilute," while softening agent levels in the range of 5-10% by weight are sometimes called "semi-dilute." Dilute, ultra dilute and semi-dilute fabric softener compositions, each of which are all considered low solids (or low active) compositions, usually have very low viscosity (with minimal or no thickening agents (viscosity control agents)) due to the low active concentration.

Industrial production of liquid softeners, however, demands a high amount of water and expensive packages. The most common and popular rinse-added fabric conditioner products are liquid products. Rinse-added liquid softeners are easy to handle, e.g., easy to dispense and to measure. The liquid form also minimizes the potential for concentrated deposition of the softener on an area of a fabric to cause visible staining. Some automatic clothes washers built with an automatic fabric softener dispenser require the fabric softener in liquid form for proper dispensing.

On the other hand, liquid fabric softener compositions contain a high level of water. The traditional liquid fabric softener products normally contain about 90% to about 95% of water. These products require a great amount of packaging material, the transport of large weight (making shipping expensive), and large shelf space in the retail stores. Recent trends to produce concentrated fabric softeners, with the intention of reducing waste, have improved the environmental impact and decreased the water content in the liquid compositions to about 72% to 80%, which is still a significant amount of water. Parallel with the effort to increase the level of fabric softener active in the liquid composition, another significant improvement in the fabric softener art is the development of rapidly biodegradable fabric softener actives to improve the environmental friendliness of fabric softener products. The new actives consist mainly of cationic quaternary ammonium compounds containing long chain alkyl groups, with at least one ester functional group inserted in some or all of the long chain alkyl groups. Such cationic quaternary ammonium compounds are disclosed, e.g., in E. P. Appln 409,502, Tandela et al., published Jan. 23, 1991; Jap. Pat. Appln 63-194,316, filed Nov. 21, 1988; Jap. Pat. Appln. 4-333,667, published Nov. 20, 1992; Jap. Laid Open Publication 1,249,129, filed Oct. 4, 1989; U.S. Pat. No. 4,767,547, issued Aug. 30, 1988; U.S. Pat. No. 4,808,321, issued Feb. 28, 1989; E. P. Appln 243,735, published Nov. 4, 1987; and U.S. Pat. No. 5,066,414, issued Nov. 19, 1991, all said patents and patent applications being incorporated herein by reference. Liquid formulations also have the disadvantage that the formulations can become unstable upon long term storage, leading to separation of the ingredients. Liquid formulations can also suffer from extremes of temperature, such as freezing temperatures or extremely warm storage temperatures.

In contrast the benefits of solid compositions include: the compactness of the compositions permit the transport of less weight, making shipping more economical; less packaging is required so that smaller and more readily disposable containers can be used; there is less chance for messy leakage; and less shelf space is required in the retail stores. Solid formulations are also more stable to storage, and extremes of temperature.

Despite the many advantages listed above, it is still a challenge to develop a formulation of a solid softener that has a performance comparable to a liquid softener with the same kind and amount of active content. The first challenge in producing a solid softener is developing a formulation that will not melt, "weep", or separate during typical storage and transport temperatures. Some softening actives, such as dimethyl distearyl ammonium chloride, are themselves already solids at room temperature, so there is little challenge in formulating them into a non-weeping composition. These solid softening actives are effective at softening, but they are not biodegradable and are not considered environmental friendly. The preferred softening actives are biodegradable, such as triethanolamine diester quats (one example of which is methyl bix(ethyl tallowate)-2-hydroxyethyl ammonium methyl sulfate). These biodegradable actives are typically low melting solids that are semi-solid at room temperature, and are much harder to formulate into a non-weeping product.

U.S. Pat. No. 4,769,159 to Copeland describes a solid cast fabric softening product comprising a softening quaternary ammonium cationic surfactant and a blend of dicarboxylic acids. In this case the softening actives being used, such as dimethyl distearyl ammonium chloride, are themselves already solids at room temperature, so there is little challenge in producing a non-weeping formulation. U.S. Pat. No. 6,110,886 to Scepanski describes a solid cast fabric softening product that comprises cationic surfactant and citric acid, but depends upon fatty amines and fatty amine oxides for softening rather than biodegradable quaternary ammonium compounds.

The second challenge in producing a solid softener is developing a formulation that will have an adequate dispense rate when sprayed with water at the typical dispense temperatures of from 46° C. to 54° C. If the dispense rate is too slow it will not be possible to deliver the required amount of formulation during the normal rinse cycle.

As such there is a need for a method to formulate a solid concentrated fabric softener composition based on biodegradable quaternary ammonium compounds.

Accordingly it is an object herein to provide a solid concentrate fabric softener composition that has an actives content of greater than 20%.

It is yet another object of the invention to provide a solid fabric softener that performs at least as well as traditional liquid compositions.

It is yet another object of the invention to provide a solid fabric softener that will have an adequate dispense rate when sprayed with water of from 40° C. to 60° C.

It is yet another object of the invention to provide a solid fabric softener than dissolves appropriately in the rinse cycle, does not "weep" or separate during typical storage and transport temperatures.

It is yet another object to provide a fabric softening composition that is safe, environmentally friendly and economically feasible.

Other objects, aspects and advantages of this invention will be apparent to one skilled in the art in view of the following disclosure, the drawings, and the appended claims.

SUMMARY OF THE INVENTION

According to the invention, a solid fabric softening composition may be formulated and stabilized with a mixture including a combination of a water soluble organic salt and a medium to long chain carboxylic acid. This stabilizing combination has been shown to effectively form a solid quaternary ammonium based fabric softening composition with up to as much as 70% by weight of quaternary ammonium compound. The formulations are stable at typical storage temperatures of up to 110° F. and provide fabric softening similar to other traditional liquid formulations.

The solid fabric softener formulation comprises from about 0.1-4% by weight of medium to long chain carboxylic acid and from about 10-60% by weight of water soluble organic salt. In general, the carboxylic acid is only added as needed to help solidify the formulation since it also reduces the dispense rates. As the quaternary ammonium compound level increases the water soluble organic salt level must decrease to make room in the formulation, while at the same time the carboxylic acid is increased gradually to help solidify the increasingly soft ammonium quaternary-rich formulation.

As the cationic quaternary ammonium compound level increases therefore the water soluble organic salt to carboxylic acid ratio decreases. Additional components may also be added such as an acidulant, a salt for conductivity, silicone and fragrance.

In another aspect, the presently described technology provides a process to prepare a solids fabric softener composition of the present technology. The process can include the steps of: (a) adding a proper amount of solidification aiding mixture of a carboxylic acid and a water soluble organic salt to a cationic quaternary ammonium compound such that a stable, non-weeping solid is formed in amounts of from about 25% to about 70% by weight of cationic quaternary ammonium compound, from about 0.1-4% by weight of medium to long chain carboxylic acid, and from about 10-60% by weight of water soluble organic salt and (b) forming a solid from the above mixture.

A novel method within the invention involves placing a solid fabric softener into a washing machine at or before a rinse cycle. The washing machine agitates the laundry in the presence of the softener. The washing machine is then drained.

DETAILED DESCRIPTION

While the presently described technology will be described in connection with one or more preferred embodiments, it will be understood by those skilled in the art that the technology is not limited to only those particular embodiments. To the contrary, the presently described technology includes all alternatives, modifications, and equivalents as may be included within the spirit and scope of the appended claims.

As used herein, a solid softening composition refers to a softening composition in the form of a solid such as a powder, a particle, an agglomerate, a flake, a granule, a pellet, a tablet, a lozenge, a puck, a briquette, a brick, a solid block, a unit dose, or another solid form known to those of skill in the art. The term "solid" refers to the state of the detergent composition under the expected conditions of storage and use of the solid detergent composition. In general, it is expected that the softening composition will remain in solid form when exposed to temperatures of 38° C. and preferably 49° C. A cast, pressed, or extruded "solid" may take any form including a block. When referring to a cast, pressed, or extruded solid it is meant that the hardened composition will not flow perceptibly and will substantially retain its shape under moderate stress or pressure or mere gravity, as for example, the shape of a mold when removed from the mold, the shape of an article as formed upon extrusion from an extruder, and the like. The degree of hardness of the solid cast composition can range from that of a fused solid block, which is relatively dense and hard, for example, like concrete, to a consistency characterized as being malleable and sponge-like, similar to caulking material.

It should be noted that, as used in this specification and the appended claims, the singular forms "a," "an," and "the" include plural referents unless the content clearly dictates otherwise. Thus, for example, reference to a composition containing "a compound" includes a mixture of two or more compounds. It should also be noted that the term "or" is generally employed in its sense including "and/or" unless the content clearly dictates otherwise.

The term "actives" or "percent actives" or "percent by weight actives" or "actives concentration" are used interchangeably herein and refers to the concentration of those ingredients involved in cleaning expressed as a percentage minus inert ingredients such as water or salts.

As used herein, "weight percent," "wt. %," "percent by weight," "% by weight," and variations thereof refer to the concentration of a substance as the weight of that substance divided by the total weight of the composition and multiplied by 100. It is understood that, as used here, "percent," "%," and the like are intended to be synonymous with "weight percent," "wt. %," etc.

The term "about," as used herein, modifying the quantity of an ingredient in the compositions of the invention or employed in the methods of the invention refers to variation in the numerical quantity that can occur, for example, through typical measuring and liquid handling procedures used for making concentrates or use solutions; through inadvertent error in these procedures; through differences in the manufacture, source, or purity of the ingredients employed to make the compositions or carry out the methods; and the like. The term about also encompasses amounts that differ due to different equilibrium conditions for a composition resulting from a particular initial mixture. Whether or not modified by the term "about," the claims include equivalents to the quantities. All numeric values are herein assumed to be modified by the term "about," whether or not explicitly indicated. The term "about" generally refers to a range of numbers that one of skill in the art would consider equivalent to the recited value (i.e., having the same function or result). In many instances, the terms "about" may include numbers that are rounded to the nearest significant figure.

The recitation of numerical ranges by endpoints includes all numbers subsumed within that range (e.g., 1 to 5 includes 1, 1.5, 2, 2.75, 3, 3.80, 4, and 5).

Compositions of the Invention

According to the invention, the solid fabric softening formulations include (1) a cationic quaternary ammonium compound stabilized in a solid formulation with a combination of (II) a medium to long chain carboxylic acid and (III) a water soluble organic salt.

(I) Quaternary Ammonium Compound

Quaternary ammonium compounds have long been known in the art for their fabric softening capabilities in liquid formulations, and have the following general formula:

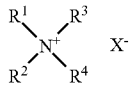

wherein $R^1$ and $R^2$ represent the same or different hydrocarbyl groups having from about 12 to about 24 carbon atoms; $R^3$ and $R^4$ represent the same or different hydrocarbyl groups containing about 1 to about 4 carbon atoms; and X is an anion, preferably selected from halide, methyl sulphate or ethyl sulphate radicals.

Representative examples of these quaternary softeners include, for example, di(tallow alkyl)dimethyl ammonium methyl sulphate; dihexadecyl dimethyl ammonium chloride; di(hydrogenated tallow alkyl)dimethyl ammonium chloride; dioctadecyl dimethyl ammonium chloride; di(hydrogenated tallow alkyl)dimethyl ammonium methyl sulphate; dihexadecyl diethyl ammonium chloride; di(coconut alkyl)dimethyl ammonium chloride; ditallow alkyl dimethyl ammonium chloride; and di(hydrogenated tallow alkyl)dimethyl ammonium chloride, and combinations thereof.

Other preferred quaternary softeners can contain ester or amide links, such as those available under the trade names ACCOSOFT® (available from Stepan Company, Northfield, Ill.), VARISOFT® (available from Degussa Corporation, Parsippany, N.J.), and STEPANTEX® (available from Stepan Company).

It is especially preferred that the additional fabric softening active of the present technology be a quaternary ammonium material which comprises a compound having at least two or more $C_{12-18}$ alkyl or alkenyl groups connected to the molecule via at least one ester link. It is more preferred that the quaternary ammonium compound have two or more ester links present. The especially preferred ester-linked quaternary ammonium compounds (i.e., ester quats) for use in the presently described technology can be represented by the formula:

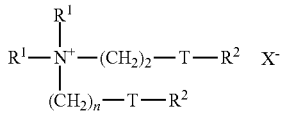

wherein each $R^1$ group is independently selected from $C_{1-4}$ alkyl, hydroxyalkyl (e.g. hydroxyethyl) or $C_{2-4}$ alkenyl groups; and wherein each $R_2$ group is independently selected from $C_{8-28}$ alkyl or alkenyl groups; T is

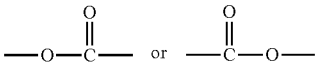

$X.^-$ is any suitable anion and n is 0 or an integer from 1-5.

Preferred compounds of this class of cationic fabric softening compounds suitable for use in various compositions of the present technology include, for example, di-alkenyl esters of triethanol ammonium methyl sulphate and N,N-di(tallowoyloxy ethyl)N,N-dimethyl ammonium chloride. Commercial examples of compounds include, but are not limited to, TETRANYL® AOT-1 (di-oleic ester of triethanol ammonium methyl sulphate 80% active by weight), TETRANYL®. A0-1 (di-oleic ester of triethanol ammonium methyl sulphate 90% active by weight), TETRANY®. L1/90 (partially hardened tallow ester of triethanol ammonium ethyl sulphate 90% active by weight), TETRANYL®. L5/90 (palm ester of triethanol ammonium methyl sulphate 90% active by weight), and TETRANYL® AHT-1 (hardened tallow ester of triethanol ammonium methyl sulphate 90% active by weight), all available from Kao Corporation, Japan, and REWOQUAT®. 'WE15 ($C_{10}$-$C_{20}$ and $C_{16}$-$C_{20}$ unsaturated carboxylic acid reaction products with triethanolamine dimethyl sulphate quaternized 90% active by weight), available from Witco Corporation, Greenwich, Conn.

A second preferred type of quaternary ammonium material of the present technology can be represented by formula:

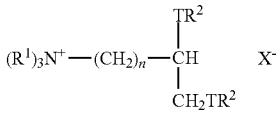

wherein $R^1$, $R^2$, T, $X.^-$ and n are as defined above. Preferred compounds of this type include, for example, 1,2 bis[hardened tallowoyloxy]-3-trimethylammonium propane chloride, and their methods of preparation are, for example, described in U.S. Pat. No. 4,137,180 (Lever Brothers Company, New York, N.Y.). Preferably these materials comprise small amounts of the corresponding monoester as described in U.S. Pat. No. 4,137,180 such as a 1-hardened tallowoyloxy-2-hydroxy trimethylammonium propane chloride.

It is advantageous for environmental reasons that the quaternary ammonium material for the present technology be biologically degradable, for example, such as those materials described in U.S. Pat. No. 6,958,313 (The Procter & Gamble Company, Cincinnati, Ohio).

The fabric softening active may also be a polyol ester quat (PEQ) as described in EP 0638 639 (Akzo Nobel, Netherlands). Other additional fabric softening actives may also be applicable in the present technology. For example those described in "Cationic surface active agents as fabric softeners," R. R. Egan, Journal of American Oil Chemist Society, January 1978, Pages 118-121; "How to chose cationic for fabric softeners," J. A. Ackerman, Journal of American Oil Chemist Society, June 1983, pages 1166-1169; and "Rinse-Added Fabric Softener Technology at the Close of the Twentieth Century," M. I. Levinson, Journal of Surfactants and Detergents, April 1999, Vol. 2, Pages 223-235, incorporated herein as references.

Examples of quaternary ammonium compounds suitable for use in the presently described technology include, but are not limited to, triethanolamine (TEA) ester quats (e.g., methyl bis(ethyl tallowate)-2-hydroxyethyl ammonium methyl sulfate), methyldiethanolamine (MDEA) ester quats, diamidoquats (e.g., methyl bis(hydrogenated tallow amidoethyl)-2-hydroxyethyl ammonium methyl sulfate), and dialkyldimethyl quats (e.g., dihydrogenated tallow dimethyl ammonium chloride). Preferred ester quats are those made from the reaction of alkyl carboxylic acid fraction, methyl ester and triglyceride with triethanolamine where the carboxylic acid and methyl ester: tertiary amine mole ratio is in the range of from about 1:1 to about 2.5:1. Specific commercially available examples of the suitable additional fabric softening active include, but are not limited to, the STEPANTEX® series products (e.g., VT-90, SP-90, and VK-90) and the ACCOSOFT® series products (e.g., 400, 440-75 and 275), all available from Stepan Company.

The ammonium quaternary fabric softening active is present at a level in the range of from about 25% to about 70%, preferably from about 30% to about 65%, and most preferably from about 35% to about 60% by weight based on the total weight of the fabric softener composition.

(II) Water Soluble Organic Salt

The water soluble organic salts of the invention include salts of organic acids such as carboxylic acids (aliphatic, acetic, formic), aromatic (benzoic, salicylic) or dicarboxylic acids such as oxalic, phthalic, sebacic, adipic, glultaric; tricarboxylic acids such as citric acid, carboxylic acids such as aliphatic (oleic, palmitic, stearic), or aromatic (phenylstearic), or even water solubeal amino acids in salt form such as those having sodium, potassium, aluminium, magnesium, titanium, ammonium, triethanolamine, diethanolamine and/or monoethanolamine as the cation Examples of water-soluble organic salts include but are not limited to $CH_3COONa$, COONa, $CH_3COOK$, $CH_3CH_2COOK$ and the like as well as mixtures thereof.

The water soluble organic salt is present in the formulation from about 5% to about 60%, preferably from about 8% to about 50%, and most preferably from about 10% to about 40% by weight based on the total weight of the fabric softener composition.

(III) Carboxylic Acid

The solid fabric softener includes a medium to long chain carboxylic acid as a stabilizer. Suitable carboxylic acids may be saturated or unsaturated, but are preferably saturated carboxylic acids. These carboxylic acids have from about 10 to about 22 carbon atoms on the alkyl or alkenyl chain, and are in either straight chain or branched chain configuration, preferable carboxylic acids are in straight chain configuration having from about 14 to about 22 carbon atoms. Non-limiting examples of useful carboxylic acids include stearic acid (C18), palmitic acid (C16) or behenic acid (C22).

The carboxylic acid is present at a level of from about 0.1% to about 5.0% by weight based on the total weight of the composition preferably from about 0.5% to about 4.5%, and most preferably from about 1% to about 4% by weight based on the total weight of the fabric softener composition.

The composition may also include additional components including but not limited to acidulants, salts, silicone, fragrance, dispersants, soil release polymers, optical brighteners, anti-wrinkling polymers, anti-redeposition polymers, oxygen bleach catalysts, microencapsulated fragrance, and the like.

Acidulants

Acidic materials can be added to the fabric softeners of the present invention. The acid has to be compatible with the other ingredients in the composition. The preferred acids would tend to buffer near the pH range between 5 and 6.5. The acid will be present in concentrations between 0 percent and about 60 percent by weight, from about 5 to about 50 percent by weight, or from about 10 to about 40 percent by weight of the fabric softening composition. A wide range of acidic materials can be used including, but not limited to: oxalic acid, citric acid, gluconic acid, tartaric acid, nitrilotriacetic acid, ethylenediamine tetraacetic acid, amino tri(methylene phosphonic) acid, 1-hydroxyethylidine-1,1-diphosphonic acid, hexamethylene diamine tetra(methylene phosphonic acid), ammonium or sodium bifluoride, ammonium or sodium silicofluoride, ammonium or sodium bisulfate, ammonium or sodium bisulfate, hydroxyacetic acid, phosphoric acid, sulfamic acid. Of particular use is a C4-C6 dicarboxylic acid blend called Sokalan DCS by BASF.

In some applications, it is preferred to use an acid that not only affects the pH, but also is capable of chelating iron over the pH range of 2 to 8. Dissolved iron in both ferric and ferrous oxidation states is found in many water supplies used for laundering fabrics. Iron can enter the water supply from the water source whether groundwater or surface water or from iron pipes either used in the municipal water supply or for plumbing at the site. Even small amounts of dissolved iron, less than 0.5 ppm, can cause white fabrics to yellow or colored fabrics to discolor over time. Water softening equipment used to remove the calcium and magnesium ions from hard water does not completely remove troublesome iron ions from the water.

Acids with no ability to chelate iron are acceptable in laundries with little or no iron in the water and, in these circumstances, would be preferred because they are substantially lower in cost than acids with iron chelating anions. Preferred iron chelating acids include citric acid, gluconic acid and amino tri(methylene phosphonic acid). Citric acid is the most preferred acid material since it acidifies, buffers in the proper range, chelates iron and is mild to fabrics and skin. Preferred non-iron chelating acids include ammonium bifluoride and ammonium silicofluoride.

Salt for Conductivity

The composition may also include at least one salt of an inorganic anion or non-sequestering organic anion to allow for standard measurements of conductivity of the wash solution. Sodium chloride is preferably used, however a wide variety of ionizable salts can be used. Examples of suitable salts are the halides and acetates of the group IA metals of the Periodic Table of the Elements, for example, lithium chloride sodium chloride, potassium chloride, ammonium chloride, sodium bromide, potassium bromide, calcium bromide, sodium iodide, potassium iodide, sodium acetate, potassium acetate, or mixtures thereof. Sodium chloride is preferred. The ionizable salts are particularly useful during the process of mixing the ingredients to make the compositions herein, and later to obtain the desired conductivity for measurement of disbursement rates of the softening composition. The amount of ionizable salts used depends on the amount of active ingredients used in the compositions and can be adjusted according to the desire of the formulator. Typical levels of salts used to control the composition viscosity are from 0 to about 40% preferably from about 10% to about 35%, and more preferably from about 15% to about 30% of the composition.

Fragrance

The present invention can contain any softener compatible fragrance/perfume. Suitable perfumes are disclosed in U.S. Pat. No. 5,500,138, said patent being incorporated herein by reference.

As used herein, perfume or fragrance includes fragrant substance or mixture of substances including natural (i.e., obtained by extraction of flowers, herbs, leaves, roots, barks, wood, blossoms or plants), artificial (i.e., a mixture of different nature oils or oil constituents) and synthetic (i.e., synthetically produced) odoriferous substances. Such materials are often accompanied by auxiliary materials, such as fixatives, extenders, stabilizers and solvents. These auxiliaries are also included within the meaning of "perfume", as used herein. Typically, perfumes are complex mixtures of a plurality of organic compounds.

Examples of perfume ingredients useful in the perfumes of the present invention compositions include, but are not limited to, hexyl cinnamic aldehyde; amyl cinnamic aldehyde; amyl salicylate; hexyl salicylate; terpineol; 3,7-dimethyl-cis-2,6-octadien-1-ol; 2,6-dimethyl-2-octanol; 2,6-dimethyl-7-octen-2-ol; 3,7-dimethyl-3-octanol; 3,7-dimethyl-trans-2,6-octadien-1-ol; 3,7-dimethyl-6-octen-1-ol; 3,7-dimethyl-1-octanol; 2-methyl-3-(para-tert-butylphenyl)-propionaldehyde; 4-(4-hydroxy-4-methylpentyl)-3-cyclohexene-1-carboxaldehyde; tricyclodecenyl propionate; tricyclodecenyl acetate; anisaldehyde; 2-methyl-2-(para-isopropylphenyl)-propionaldehyde; ethyl-3-methyl-3-phenyl glycidate; 4-(para-hydroxyphenyl)-butan-2-one; 1-(2,6,6-trimethyl-2-cyclohexen-1-yl)-2-buten-1-one; para-methoxyacetophenone; para-methoxy-alpha-phenylpropene; methyl-2-n-hexyl-3-oxo-cyclopentane carboxylate; undecalactone gamma.

Additional examples of fragrance materials include, but are not limited to, orange oil; lemon oil; grapefruit oil; bergamot oil; clove oil; dodecalactone gamma; methyl-2-(2-pentyl-3-oxo-cyclopentyl)acetate; beta-naphthol methyl-ether; methyl-beta-naphthylketone; coumarin; decylaldehyde; benzaldehyde; 4-tert-butylcyclohexyl acetate; alpha,alpha-dimethylphenethyl acetate; methylphenylcarbinyl acetate; Schiffs base of 4-(4-hydroxy-4-methyl-pentyl)-3-cyclohexene-1-carboxaldehyde and methyl anthranilate; cyclic ethyleneglycol diester of tridecandioic acid; 3,7-dimethyl-2,6-octadiene-1-nitrile; ionone gamma methyl; ionone alpha; ionone beta; petitgrain; methyl cedrylone; 7-acetyl-1,2,3,4,5,6,7,8-octahydro-1,1,6,7-tetramethyl-naphthalene; ionone methyl; methyl-1,6,10-trimethyl-2,5,9-cyclododecatrien-1-yl ketone; 7-acetyl-1,1,3,4,4,6-hexamethyl tetralin; 4-acetyl-6-tert-butyl-1-,1-dimethyl indane; benzophenone; 6-acetyl-1,1,2,3,3,5-hexamethyl indane; 5-acetyl-3-isopropyl-1,1,2,6-tetramethyl indane; 1-dodecanal; 7-hydroxy-3,7-dimethyl octanal; 10-undecen-1-al; isohexenyl cyclohexyl carboxaldehyde; formyl tricyclodecan; cyclopentadecanolide; 16-hydroxy-9-hexadecenoic acid lactone; 1,3,4,6,7,8-hexahydro-4,6,6,7,8,8-hexamethylcyclopenta-gamma-2-benzopyrane; ambroxane; dodecahydro-3a,6,6,9a-tetramethylnaphtho-[2,1b]furan; cedrol; 5-(2,2,3-trimethylcyclopent-3-enyl)-3-methylpentan-2-ol; 2-ethyl-4-(2,2,3-trimethyl-3-cyclopenten-1-yl)-2-buten-1-ol; caryophyllene alcohol; cedryl acetate; para-tert-butylcyclohexyl acetate; patchouli; olibanum resinoid; labdanum; vetivert; copaiba balsam; fir balsam; and condensation products of: hydroxycitronellal and methyl anthranilate; hydroxycitronellal and indol; phenyl acetaldehyde and indol; 4-(4-hydroxy-4-methyl pentyl)-3-cyclohexene-1-carboxaldehyde and methyl anthranilate.

More examples of perfume components are geraniol; geranyl acetate; linalool; linalyl acetate; tetrahydrolinalool; citronellol; citronellyl acetate; dihydromyrcenol; dihydromyrcenyl acetate; tetrahydromyrcenol; terpinyl acetate; nopol; nopyl acetate; 2-phenylethanol; 2-phenylethyl acetate; benzyl alcohol; benzyl acetate; benzyl salicylate; benzyl benzoate; styrallyl acetate; dimethylbenzylcarbinol; trichloromethylphenylcarbinyl methylphenylcarbinyl acetate; isononyl acetate; vetiveryl acetate; vetiverol; 2-methyl-3-(p-tert-butylphenyl)-pr-opanal; 2-methyl-3-(p-isopropylphenyl)-propanal; 3-(p-tert-butylphenyl)-pr-opanal; 4-(4-methyl-3-pentenyl)-3-cyclohexenecarbaldehyde; 4-acetoxy-3-pentyltetrahydropyran; methyl dihydrojasmonate; 2-n-heptylcyclopentanone; 3-methyl-2-pentyl-cyclopentanone; n-decanal; n-dodecanal; 9-decenol-1; phenoxyethyl isobutyrate; phenylacetaldehyde dimethylacetal; phenylacetaldehyde diethylacetal; geranonitrile; citronellonitrile; cedryl acetal; 3-isocamphylcyclohexanol; cedryl methylether; isolongifolanone; aubepine nitrile; aubepine; heliotropine; eugenol; vanillin; diphenyl oxide; hydroxycitronellal ionones; methyl ionones; isomethyl ionomes; irones; cis-3-hexenol and esters thereof; indane musk fragrances; tetralin musk fragrances; isochroman musk fragrances; macrocyclic ketones; macrolactone musk fragrances; ethylene brassylate.

The perfumes useful in the present invention compositions are substantially free of halogenated materials and nitromusks. Suitable solvents, diluents or carriers for perfumes ingredients mentioned above are for examples, ethanol, isopropanol, diethylene glycol, monoethyl ether, dipropylene glycol, diethyl phthalate, triethyl citrate, etc. The amount of such solvents, diluents or carriers incorporated in the perfumes is preferably kept to the minimum needed to provide a homogeneous perfume solution.

The perfumes used in the present invention may also be present in the form of microcapsules, such as those produced from melamine and formaldehyde. One suitable example of microcapsule technology is the Mechacap® product line by Givaudan Fragrances Corp.

Perfume/fragrance can be present at a level of from about 0% to about 10%, preferably from about 0.1% to about 5%, and more preferably from about 0.2% to about 3%, by weight of the finished composition.

Silicone

The solid fabric softener composition also optionally comprises an organosilicone, such as: a polyalkyl silicone, an aminosilicone, a siloxane, a polydimethyl siloxane, an ethoxylated organosilicone, a propoxylated organosilicone, an ethoxylated/propoxylated organosilicone, and mixtures thereof. In one embodiment, the organosilicone is an amino polysiloxane.

Organosilicones not only provide softness and smoothness to fabrics, but also provide a substantial color appearance benefit to fabrics, especially after multiple laundry washing cycles. It has also been postulated that organosilicones provide an anti-abrasion benefit to fabrics in the washing or rinse cycles of an automatic washing machine by reducing friction of the fibers. Suitable polymers for use herein are described in US Patent Publ. No. 2006/0217288 A1 to Wahl et al. at 11-27. Suitable organosilicones comprise Si—O moieties and may be selected from (a) non-functionalized siloxane polymers, (b) functionalized siloxane polymers, and combinations thereof. The molecular weight of the organosilicone is usually indicated by the reference to the viscosity of the material. In one aspect, the organosilicones may comprise a viscosity of from about 10 to about 2,000,000 centistokes at 25° C. In another aspect, suitable organosilicones may have a viscosity of from about 10 to about 800,000 centistokes at 25° C. Suitable organosilicones may be linear, branched or cross-linked. Suitable organosilicones may be in the form of neat liquids, combinations with solvents, or emulsions in water. If aqueous emulsions are used the preferred silicones are as concentrated as possible to minimize the amount of liquid added to the composition, since large amounts of liquid can complicate the solidification process. Particularly suitable silicones are FC-201 and FC-110 made by Wacker Chemical Corporation.

In one embodiment, the solid fabric softener composition comprises from about 0 to about 15%, or from about 0.5% to about 10%, or about 2% to about 8%, by weight of the solid fabric softening composition.

Optional

Dispersant

A dispersant may be included to help remove soils and microorganism from articles and surfaces. Examples of dispersants include, but are not limited to, to water soluble polymers, surfactants, hydrotropes, and wetting agents. In a preferred embodiment the dispersant is an anionic surfactant. The composition need not include a dispersant, but when a dispersant is included it can be included in an amount that provides the desired dispersant properties. Suitable ranges of the dispersant in the composition can be up to about 20 wt. %, about 0.5 to about 15 wt. %, or about 2 to about 9 wt. %.

Solidification Agent

The composition may also optionally include a solidification agent. The solidification agent in the solid fabric softening compositions participates in maintaining the compositions in a solid form. Although other components of the solid composition may also be solids, the solidification agent can maintain the overall composition including solid and liquid components in a solid form. The solidification agent can provide other advantageous features to the compositions. For example, the solidification agent can improve level or stability of foaming by cleaning agents such as surfactants.

Suitable solidification agents include a solid polyethylene glycol (PEG), a solid EO/PO block copolymer, and the like; an amide, such as stearic monoethanolamide, lauric diethanolamide, an alkylamide, or the like; starches that have been made water-soluble through an acid or alkaline treatment process; celluloses that have been made water-soluble; various inorganics that impart solidifying properties to a heated composition upon cooling; poly(maleic anhydride/methyl vinyl ether); polymethacrylic acid; other generally functional or inert materials with high melting points; and the like.

In certain embodiments, the solidification agent includes solid PEG, for example PEG 1500 up to PEG 20,000. In certain embodiments, the PEG includes PEG 1450, PEG 3350, PEG 4500, PEG 8000, PEG 20,000, and the like. Additional suitable solidification agents include EO/PO block copolymers such as those sold under the tradenames Pluronic 108, Pluronic F68; amides such as lauric diethanolamide or cocodiethylene amide; and the like. In certain embodiments, the solidification agent includes a combination of solidification agents, such as combination of PEG and an EO/PO block copolymer (such as a Pluronic) and combination of PEG and an amide (such as lauric diethanol amide or stearic monoethanol amide).

In an embodiment, for more controlled dispensing, the solidification agent is not an extremely water soluble solid, such as urea. In this embodiment, other disfavored solidification agents include other hygroscopic solids.

In certain embodiments, the present solid composition includes solidification agent at about 0 to about 30 wt. %, about 0.5 to about 20 wt. %, about 3 to about 15 wt. %. In certain embodiments, when the solidification agent is a solid PEG (e.g., PEG 8000).

Other

The formulations according to the invention can comprise, in addition to the mentioned components, additives and auxiliaries which are customary and specific in each case, for example enzymes, colorants; preservatives; surfactants; anti-shrinkage agents; fabric crisping agents; spotting agents; germicides; fungicides; anti-oxidants such as butylated hydroxy toluene, anti-corrosion agents, dyes, and sequestering agents and the like.

Suitable preservatives are, for example, phenoxyethanol, formaldehyde solution, pentanediol, isothiazolinones, benzoisothiazolines or sorbic acid.

Other optional components include but are not limited to the following.

(A) Suds Suppressor

One aspect of the invention provides for a fabric softening composition further optionally comprising a suds suppressor. Suitable suds suppressors are disclosed (referred to as "suds suppressing systems") in US 2003/0060390 A1, at paragraphs 65-77. A preferred suds suppressor is one comprising a silicone. A suitable example is Silfoam, SE90, SE39 PG, SE 39 from Wacker. In one embodiment, the fabric care composition comprises from about 0.01% to about 5% of a suds suppressor by weight of the fabric softening composition.

(B) Cationic Starch

A second aspect of the invention provides for a fabric care composition further optionally comprising a cationic starch. Cationic starches are disclosed in US 2004/0204337 A1. In one embodiment, the fabric care composition comprises from about 0.1% to about 7% of cationic starch by weight of the fabric care composition. In one embodiment, the cationic starch is HCP401 from National Starch.

(C) Scum Dispersant

In one aspect of the invention, the fabric care composition can optionally comprise a scum dispersant. Suitable scum dispersants are described in US 2003/0126282 A1, paragraphs 89-90.

(D) Bactericides

Examples of bactericides that can be optionally used in the compositions of this invention include glutaraldehyde, formaldehyde, 2-bromo-2-nitro-propane-1,3-diol sold by Inolex Chemicals, located in Philadelphia, Pa., under the trade name Bronopol®, and a mixture of 5-chloro-2-methyl-4-isothiazoline-3-one and 2-methyl-4-isothiazoline-3-one sold by Rohm and Haas Company under the trade name Kathon 1 to 1,000 ppm by weight of the agent.

(E) Chelating Agents

The compositions and processes herein can optionally employ one or more copper and/or nickel chelating agents ("chelators"). Such water-soluble chelating agents can be selected from the group consisting of amino carboxylates, amino phosphonates, polyfunctionally-substituted aromatic chelating agents and mixtures thereof, all as hereinafter defined. The whiteness and/or brightness of fabrics are substantially improved or restored by such chelating agents and the stability of the materials in the compositions is improved.

Amino carboxylates useful as chelating agents herein include ethylenedi-aminetetraacetates (EDTA), N-hydroxyethylethylenediaminetriace-tates, nitrilotriacetates (NTA), ethylenediamine tetraproprionates, ethylenediamine-N,N'-diglutamates, 2-hyroxypropylenediamine-N,N'-disuccinates, triethylenetetraaminehexacetates, diethylenetriaminepentaacetates (DETPA), and ethanoldiglycines, including their water-soluble salts such as the alkali metal, ammonium, and substituted ammonium salts thereof and mixtures thereof.

Amino phosphonates are also suitable for use as chelating agents in the compositions of the invention when at least low levels of total phosphorus are permitted in detergent compositions, and include ethylenediaminetetrakis(methylenephosphonates), diethylenetriamine-N,N,N-',N",N"-pentakis (methane phosphonate) (DETMP) and 1-hydroxyethane-1,1-diph-osphonate (HEDP). Preferably, these amino phosphonates to not contain alkyl or alkenyl groups with more than 6 carbon atoms.

The chelating agents are typically used in the present rinse process at levels from 2 ppm to 25 ppm, for periods from 1 minute up to several hours' soaking.

(F) Enzyme

The compositions and processes herein can optionally employ one or more enzymes such as lipases, proteases, cellulase, amylases and peroxidases. A preferred enzyme for use herein is a cellulase enzyme. Indeed, this type of enzyme will further provide a color care benefit to the treated fabric. Cellulases usable herein include both bacterial and fungal types, preferably having a pH optimum between 5 and 9.5. U.S. Pat. No. 4,435,307 discloses suitable fungal cellulases from Humicola insolens or Humicola strain DSM1800 or a cellulase 212-producing fungus belonging to the genus Aeromonas, and cellulase extracted from the hepatopancreas of a marine mollusk, Dolabella Auricula Solander. Suitable cellulases are also disclosed in GB-A-2.075.028; GB-A-2.095.275 and DE-OS-2.247.832. CAREZYME® and CELLUZYME® (Novo) are especially useful. Other suitable cellulases are also disclosed in WO 91/17243 to Novo, WO 96/34092, WO 96/34945 and EP-A-0,739,982. In practical terms for current commercial preparations, typical amounts are up to 5 mg by weight, more typically 0.01 mg to 3 mg, of active enzyme per gram of the detergent composition. Stated otherwise, the compositions herein will typically comprise from 0.001% to 5%, preferably 0.01%-1% by weight of a commercial enzyme preparation. In the particular cases where activity of the enzyme preparation can be defined otherwise such as with cellulases, corresponding activity units are preferred (e.g. CEVU or cellulase Equivalent Viscosity Units). For instance, the compositions of the present invention can contain cellulase enzymes at a level equivalent to an activity from about 0.5 to 1000 CEVU/gram of composition. Cellulase enzyme preparations used for the purpose of formulating the compositions of this invention typically have an activity comprised between 1,000 and 10,000 CEVU/gram in liquid form, around 1,000 CEVU/gram in solid form.

(G) Surfactant

The solid fabric softening composition can optionally include an additional surfactant or surfactant system in addition to their potential use as a dispersant described above. A variety of surfactants can be used in the present solid fabric softening composition, including anionic, nonionic, cationic, and zwitterionic surfactants, which are commercially available. In certain embodiments, the surfactants include nonionic surfactants, anionic surfactants, or mixtures thereof. For a discussion of surfactants, see Kirk-Othmer, Encyclopedia of Chemical Technology, Third Edition, volume 8, pages 900-912.

In certain embodiments, the present solid composition includes surfactant at about 0.1 to about 60 wt. %, about 1 to about 30 wt. %, about 1 to about 40 wt. %, about 10 to about 50 wt. %, or about 20 to about 40 wt. %.

Nonionic surfactants useful in the present solid compositions, include those having a polyalkylene oxide polymer as a portion of the surfactant molecule. These surfactants can be capped or uncapped. Such nonionic surfactants include, for example, chlorine-, benzyl-, methyl-, ethyl-, propyl-, butyl- and other like alkyl-capped polyethylene glycol ethers of carboxylic alcohols; polyalkylene oxide free nonionics such as alkyl polyglycosides; sorbitan and sucrose esters and their ethoxylates; alkoxylated ethylene diamine; alcohol alkoxylates such as alcohol ethoxylate propoxylates, alcohol propoxylates, alcohol propoxylate ethoxylate propoxylates, alcohol ethoxylate butoxylates, carboxylic alcohol ethoxylates (e.g., tridecyl alcohol alkoxylate, ethylene oxide adduct), and the like; nonylphenol ethoxylate, polyoxyethylene glycol ethers, and the like; carboxylic acid esters such as glycerol esters, polyoxyethylene esters, ethoxylated and glycol esters of carboxylic acids, and the like; carboxylic amides such as diethanolamine condensates, monoalkanolamine condensates, polyoxyethylene carboxylic acid amides, and the like; and polyalkylene oxide block copolymers including an ethylene oxide/propylene oxide block is copolymer such as those commercially available under the trademark PLURONIC (BASF-Wyandotte), and the like; ethoxylated amines and ether amines commercially available from Tomah Corporation and other like nonionic compounds. Silicone surfactants such as the ABIL B8852 (Goldschmidt) can also be used.

In certain embodiments, the nonionic surfactant includes alkyl phenol ethoxylate, linear and secondary alcohol ethoxylate (carboxylic alcohol ethoxylate, e.g., tridecyl alcohol alkoxylate, ethylene oxide adduct), ethoxy/propoxy block surfactant, polyether siloxane, or mixture thereof. Examples of suitable nonionic surfactants include EO/PO block nonionic surfactant terminated in PO, silicone nonionic surfactant, benzyl ether of a polyethoxylated primary alcohol, nonylphenol ethoxylate (e.g., nonylphenol 9.5 mole ethoxylate), and the like.

In certain embodiments, the nonionic surfactant is present at about 1 to about 30 wt. %, about 5 to about 20 wt. %, or about 10 to about 15 wt. %. In an embodiment, the nonionic surfactant is present at about 15 (e.g., 14) wt. %. The composition can include any of these ranges or amounts not modified by about.

Anionic surfactants useful in the present solid cleaning compositions, include, for example, carboxylates such as alkylcarboxylates (carboxylic acid salts) and polyalkoxycarboxylates, alcohol ethoxylate carboxylates, nonylphenol ethoxylate carboxylates, and the like; sulfonates such as alkylsulfonates, alkylbenzenesulfonates (e.g, linear dodecyl benzene sulfonic acid or salts thereof), alkylarylsulfonates, sulfonated carboxylic acid esters, and the like; sulfates such as sulfated alcohols, sulfated alcohol ethoxylates, sulfated alkylphenols, alkylsulfates, sulfosuccinates, alkylether sulfates, and the like; and phosphate esters such as alkylphosphate esters, ethoxylated alcohol phosphate esters, and the like. In certain embodiments, the anionic surfactant includes sodium alkylarylsulfonate, alkylbenzenesulfonate (e.g, linear dodecyl benzene sulfonic acid or salts thereof), ethoxylated alcohol phosphate ester, alpha-olefin sulfonate, carboxylic alcohol sulfate, or mixture thereof.

In certain embodiments, the anionic surfactant is present at about 1 to about 40 wt. %, about 1 to about 20 wt-%, about 3 to about 15 wt-%, about 5 to about 30 wt-%, about 5 to about 10 wt. %, or about 5 to about 10 wt. %, or about 10 to about 20 wt. %. In certain embodiments, the anionic surfactant is present at about 8 wt. % or about 16 wt. %. The composition can include any of these ranges or amounts not modified by about.

Although not limiting to the present invention, it is believed that surfactant, particularly surfactant that is a liquid at room temperature, can be fixed in the solid cleaning composition, for example, as a complex with one or more salts. Such a complex can be envisioned as similar to hydration of a salt; a hydroxyl group (or other functional group with a free electron pair) on the surfactant may complex a salt like a water of hydration. In an embodiment, the present solid cleaning compositions include a complex of a salt and a surfactant. Although not limiting to the present invention, it is believed that such a complex can impart advantageous stability for the present composition at elevated temperatures during storage and shipping.

(H) Soil Release Agent

The solid fabric softening composition can optionally include a soil release polymer or agent. A suitable example of this would be TEXCARE® SRN-240 by Clariant.

(I) Anti-Redeposition Agent

The solid fabric softening composition can optionally include an anti-redeposition agent or polymer. A suitable example of this would be ALCOSPERSE 747 by Akzo Nobel.

(J) Anti-Wrinkling Agent

The solid fabric softening composition can optionally include an anti-wrinkling agent or polymer. A suitable example of this would be REWOQUAT® SQ-1 by Evonik.

(K) Optical Brightener

The solid fabric softening composition can optionally include an optical brightener. Suitable examples would include Tinopal CBSX powdered material from Ciba, or Optiblanc NL liquid material from 3V.

(L) Oxygen Bleach Catalyst

The solid fabric softening composition can optionally include a ligand-and-complex oxygen bleach catalyst, such as the FeONIX catalyst available from Rahu Catalytics, as described in WO2002048301 and in EP1523482.

Formulating the Solid Fabric Softener Composition

The solid softener compositions according to this invention are obtained by mixing the components, heating then allowing to solidify into a cast solid. They are preferably made in the following way: (1) mixing the quaternary ammonium compound, medium to long chain carboxylic acid, water soluble organic salt and any other additional components, (2) heating and stirring the mixture obtained in step (1) to form a melt, and thereafter (3) allowing the mixture to cool to room temperature and solidify. In one embodiment, the mixture is prepared in a mechanical mixer under heating and stirring conditions The mixture in step (1) is generally heated to such a temperature in order to get a completely fluid liquid, preferably the mixture is heated to a temperature of greater than 49° C.

Higher levels of softening active in these formulations are desirable in that they provide a more highly concentrated formulation and further reduce shipping costs. But the higher the level of softening active the harder it is to make the formulation into a stable solid that is non-weeping. These higher levels of softening active require higher levels of carboxylic acid (such as stearic acid) and solidification aids (such as PEG) to achieve a formulation that is a stable solid. The drawback of adding higher levels of carboxylic acid and solidification aid is that they reduce the dispense rate of the formulation. It is desirable to dispense the softener as quickly as possible into the rinse cycle to allow for a short overall wash cycle. Therefore the optimum solid softener formulation is generally a tradeoff between high softening active level to reduce shipping (which tends to decrease dispense rate) and fast dispense rate to shorten the wash cycle time (which tends to require a lower softener active level).

The solid softener compositions according to this invention can also be prepared in the form of granules or tablets. One of the alternatives for production of both is to subject the powder, produced from the general procedure presented above, to a subsequent granulation or extrusion process.

The Fabric Softening Process

Generally for the fabric softening process, the cast solid softener is dispensed by contacting a cast solid with a sufficient amount of water to dissolve at least a portion of the solid fabric softener, thereby forming a dissolved portion of the solid cast fabric softener composition that can then be added to the rinse cycle of the laundry process. The water temperature for dispensing should be from about 40° C. to about 60° C., preferably from about 45° C. to about 55° C. The formulations of the present invention preferably dispense at greater than 10 g/min, more preferably greater than 15 g/min, and most preferably greater than 20 g/min.

The diluted liquid compositions forms using the solid particulate compositions of the present invention are preferably used in the rinse cycle of the conventional automatic laundry operations. Generally, rinse water has a temperature of from about 5° C. to about 60° C.

Fabrics or fibers are contacted with an amount of the solid softener composition that is effective to achieve the desired level of softness. Of course, the amount used is based upon the judgment of the user, depending on concentration of the softening material, fiber or fabric type, degree of softness desired, and the like. The amount of softener dispensed is typically characterized as the ratio of the amount of softening quat active to the amount of linen. This ratio is preferably in the range of from 0.01% quat active to linen to as high as 0.25%, more preferably in the range of 0.08% to 0.20%. For a solid softening composition that is 36% active quat, a dose of 101 g solid softening composition dissolved in water and added to 100 lbs of linen would result in a quat to linen ratio of 0.08%. The amount of water used to deliver this amount of solid softening composition can be any amount that can conveniently dissolve the desired dose in the required amount of time to deliver the softening composition to the rinse cycle of the machine. Using water of from 45° C. to 55° C. a 100 g dose of softening composition is typically dispensed in from 1 to 4 minutes using from 2 to 10 liters of water.

In its simplest embodiment, the solid fabric softener formulation comprises from about 25% to about 70% by weight of quaternary ammonium compound, from about 0.1-4% by weight of medium to long chain carboxylic acid, and from about 10-60% by weight of water soluble organic salt.

Exemplary ranges for compositions including additional components are shown in Table 1.

TABLE 1

Representative compositions (percent by weight):

| | First range | second range | third range |
|---|---|---|---|
| Quaternary ammonium | 25-70 | 30-65 | 35-60 |
| Organic salt | 6-60 | 8-50 | 10-40 |
| Carboxylic acid | 0.1-5 | 0.5-4.5 | 1-4 |
| Solidification aid | 0-30 | 0.5-20 | 3-15 |
| Acidulant | 0-60 | 5-60 | 10-50 |
| Dispersant | 0-20 | 0.5-15 | 2-9 |
| Silicone | 0-15 | 0.5-10 | 2-8 |
| Salt for conductivity | 0-40 | 10-35 | 15-30 |
| Fragrance | 0-10 | 0.1-5 | .2-3 |

The present invention will now be further illustrated by way of the following non-limiting examples, in which parts and percentages are by weight unless otherwise indicated.

EXAMPLES

Solid formulations shown in Table 2 were made according to the ranges listed above. Applicants were successful at producing a solid, non-weeping formulation. The ingredients were mixed together and heated to a melt above 49° C. then allowed to cool and solidify. Test samples were then subjected to the weeping protocol below.

WEEP TEST PROCEDURE: To evaluate a product's resistance to sloughing in a high humidity atmosphere.

Apparatus/Supplies: Constant temperature bath, Thermometer, Holding tub, Holding tub cover, Screen mesh stands, Analytical balance Equipment Set-Up: 1. Water level of bath should be approximately 1 inch above the bottom rack.

2. Fill holding tub with 1 inch of water and then place it into the bath water.
3. Turn on water bath and adjust temperature to ~38° C.
4. Place a cover on holding tub and also cover water bath. Allow temperature to stabilize.

Procedure: 1. Number screen mesh stands and record tare weight.

2. Record product sample weights and place one on the center of each mesh stands.
3. Transfer stands with product to holding tub. Weight of tub with samples should not present buoyancy. Product will not make contact with water.
4. Cover holding tub and place within covered bath unit. Record start time of test.
5. For the duration of the test, the product remaining on each stands is weighed and recorded along with notable observations at ~24 hour intervals.
   Test continues until product has completely sloughed into holding tub. Pictures may be taken to record daily activity.
6. Reestablish water levels in the water bath if evaporation occurs.

Calculation: All weighting are in grams. Initial product wgt−(sloughed product wgt−mesh stand tare wgt)/Initial product wgt (100)=% Wept Example: 123.69 g−[148.27 g−60.77 g]/123.69 g [100]=29% wept Considerations: Place product in a way that will prevent it from tipping (melting) beyond the edge of the stand. This may cause rapid product loss not representative of normal sloughing.

Sometime during the first 24 hours of the test the product may take on a slight gain in weight due to absorption of moisture.

Whenever a new product is undergoing this test an existing product should be run along with it for comparative insight.

Prototype samples were made in small sample cups, inverted on a mesh screen over a hot water bath, and measured periodically for wt. loss. These include control samples #52 and #56, and experimental samples #62, #65, #130, #89, #81, #83, #204, and #231.

TABLE 2

Solid Softener Formulations

| RM | #52 | #56 | #62 | #65 | #130 | #89 | #81 | #83 | #204 | #231 |
|---|---|---|---|---|---|---|---|---|---|---|
| VT-90 | 40.0 | 45.0 | 45.0 | 50.0 | 55.0 | 60.0 | 65.0 | 70.0 | 40.0 | 40.0 |
| PEG 4000 | 17.0 | | | | | | | | | 4.5 |
| PEG 8000 | | 10.0 | | | | | | | | |
| Sodium Chloride | 23.0 | | | | | | | | 20.0 | 16.0 |
| Citric Acid | 10.0 | 15.0 | 15.0 | 15.0 | 20.0 | 15.0 | 10.0 | 10.0 | | 4.0 |
| Succinic Acid | | | | | | | | | 8.0 | 10.0 |
| Sodium Acetate | | 23.0 | 31.0 | 26.0 | 17.0 | 16.0 | 15.0 | 10.0 | 23.5 | 18.0 |
| Stearic Acid | | | 3.0 | 3.0 | 2.0 | 2.0 | 3.0 | 4.0 | 1.5 | 0.5 |
| Crodasinic LS-95 | 3.0 | | | | | 1.0 | | | | |
| Wacker FC-201 | 7.0 | 7.0 | 6.0 | 6.0 | 6.0 | 6.0 | 7.0 | 6.0 | | |
| Wacker FC-110 | | | | | | | | | 6.0 | 6.0 |
| Fragrance | | | | | | | | | 1.0 | 1.0 |
| Total (%) | 100 | 100 | 100 | 100 | 100 | 100 | 100 | 100 | 100 | 100 |
| Weep at 38° C.? | No | Yes | No | No | No | No | No | No | No | No |
| Dispense @ 46° | 22 | | | 13 | 13 | | | | 18 | 25 |
| Dispense @ 49°-54° C. | | | | | | 17 | 16 | 13 | | |

Values in %, Dispense rates in g/min

From the data in Table 2 it can be seen that it was possible to make a non-weeping solid softening composition that contains 40% VT-90 quat using a combination of PEG and citric acid alone to stabilize the composition. But increasing the level of VT-90 beyond 40% gave a composition that weeped, even with addition of sodium acetate. Only by adding the stearic acid of the invention to the formula was it possible to make a non-weeping solid.

A number of the examples were scaled up to 4 lb samples and cast into plastic cylindrical capsules as shown in FIG. 1 of U.S. Pat. No. 4,769,159. After cooling these samples were dispensed using a commercially available Navigator Dispenser (Ecolab Inc., St. Paul, Minn.) as shown in FIG. 2 of U.S. Pat. No. 4,769,159, using water at between 46° and 54° C. The amount that was dispensed over a 4 min period was determined by difference weighing the capsule before and after dispensing to give an average dispense rate in g/min.

For control sample #52, and experimental samples #65, #130, #204, and #231 the dispense water temperature was about 46° C., resulting in the indicated dispense rates. But for control sample #52 the dispense rate was not constant, indicating that the formulation had separated or settled during cooling, giving an unequal distribution of material that resulting in faster dispensing and greater electrical conductivity for the bottom portion of the formulation. Thus while it was possible to produce a non-weeping solid using control formulation #52, the dispensing performance was not satisfactory. For experimental samples #89, #81, and #83 with higher quat levels the dispense rate at 46° C. was too low, and the dispense water temperature was increased to between 49° and 54° C. to achieve reasonable dispense rates.

To demonstrate the softening ability of a solid fabric softener a 4 lb. capsule containing formulation #204 was mixed, cast into a Navigator Dispenser capsule, and installed in a Navigator Dispenser mounted to a commercial washer-extractor. A softness test was then run using 19 lbs of terry towels in a 35 lb washer-extractor, using Formula 1 (Ecolab Inc.) as detergent. The dispenser was adjusted to deliver 34 g of product, or 12 g of softening active in the final rinse cycle.

The towels were washed and treated with softener for 5 cycles, drying after each cycle. For comparison a second 19 lb set of towels were washed and treated with Clearly Soft Fabric Softener (Ecolab Inc., 60 g, 12 g of softening active), a standard commercially available liquid fabric softener, in the rinse cycle, again for five cycles. A panel then evaluated the softness of the towels on a scale of 1 to 7, with 7 being the softest. The average rating for the towels treated with Clearly Soft was a 4.7, while for Run #204 the average rating was 4.3, indicating that a solid rinse cycle fabric softener of this type is capable of achieving excellent softening performance comparable to a conventional liquid rinse cycle fabric softener.

Table 3 shows additional examples of the invention that include various optional ingredients, such as: soil release agent (TEXCARE® SRN-240, Run #400), anti-redeposition agent (ALCOSPERSE 747, Run #405), anti-wrinkling agent (REWOQUAT® SQ-1, Run #403), optical brightener (Tinopal CBSX, Run #401; Optiblanc NL, Run #404), oxygen bleach catalyst (FeONIX, Run #402), and microencapsulated fragrance (Mechacap®, Run #406). All of the samples were shown to be non-weeping at 38° C.

TABLE 3

Solid Softener Formulation with Optional Ingredients

| RM | #231 | #400 | #401 | #402 | #403 | #404 | #405 | #406 |
|---|---|---|---|---|---|---|---|---|
| VT-90 | 40 | 40 | 40 | 40 | 40 | 40 | 40 | 40 |
| PEG 4000 | 4.5 | 4.5 | 4.5 | 4.5 | 4.5 | 4.5 | 4.5 | 4.5 |
| Sodium Chloride | 16 | 16 | 16 | 16 | 16 | 16 | 16 | 16 |
| Citric Acid | 4 | 4 | 4 | 4 | 4 | 4 | 4 | 4 |
| Succinic Acid | 10 | 10 | 10 | 10 | 10 | 10 | 10 | 10 |
| Sodium Acetate | 18 | 18 | 18 | 18 | 18 | 18 | 18 | 18 |
| Stearic Acid | 0.5 | 0.5 | 0.5 | 0.5 | 0.5 | 0.5 | 0.5 | 0.5 |
| Wacker FC-110 | 6 | 6 | 6 | 6 | 6 | 6 | 6 | 6 |
| Fragrance | 1 | 1 | 1 | 1 | 1 | 1 | | |
| Texcare SRN-240 | | 1 | | | | | | |
| Alcosperse 747 | | | | | | | 1 | |
| Rewoquat SQ-1 | | | | | 1 | | | |
| Tinopal CBSX | | | 0.1 | | | | | |
| Optiblanc NL | | | | | | 0.1 | | |
| FeONIX | | | | 0.1 | | | | |
| Mechacap ® | | | | | | | | 1 |
| Total | 100 | 101 | 100.1 | 100.1 | 101 | 100.1 | 100 | 100 |
| Weep at 38° C.? | No | No | No | No | No | No | No | No |

When the plastic cylindrical capsules as shown in FIG. 1 of U.S. Pat. No. 4,769,159 are filled with solid softener formulation and then dispensed with water, it is possible that with time the center of the cast solid can dissolve faster than the edge, leaving a thin layer of solid around the perimeter. If the formulation is not sufficiently hard it is possible for this thin layer to slough off, depositing portions of the formulation into the dispenser that can then cause plugging. This is especially possible if a larger diameter 6 lb. capacity cylindrical capsule is used. Table 4 shows formulations that reduce this tendency for sloughing. One approach is to reduce the amount of liquid fragrance from 1.0% to about 0.75% (Run #254) which hardens the formulation sufficiently to reduce the incident rate of sloughing for a 6 lb capsule from 3 or more to typically less than 1. Another approach (Run #258) is to use Sokalan DCS as the acidulant, which also hardens the formulation sufficiently to reduce the incident rate of sloughing.

TABLE 4

Solid Softener Formulations to Reduce Sloughing

| RM | #231 | #254 | #258 |
|---|---|---|---|
| VT-90 | 40 | 40 | 40 |
| PEG 4000 | 4.5 | 4.5 | 4.5 |
| Sodium Chloride | 16 | 16.25 | 15 |
| Citric Acid | 4 | 4 | 4 |
| Succinic Acid | 10 | 10 | |
| Sokalan DCS | | | 11 |
| Sodium Acetate | 18 | 18 | 18 |
| Stearic Acid | 0.5 | 0.5 | 0.5 |
| Wacker FC 110 | 6 | 6 | 6 |
| Fragrance | 1 | 0.75 | 1 |
| Total | 100 | 100 | 100 |
| Weep at 38° C.? | No | No | No |
| Sloughing? | ~3 | 0-1 | 0-1 |

What is claimed is:

1. A solid fabric softening composition comprising:

(a) a fabric softening amount of a quaternary ammonium compound, (b) a medium to long chain carboxylic acid, (c) a water soluble organic salt, and (d) a silicone compound present between about 3.5 wt. % and about 15 wt. %, (e) an acidulant that buffers at a pH between about 5 and about 6.5, wherein the medium to long chain carboxylic acid and water soluble organic salt are in a ratio sufficient to stabilize the quaternary ammonium compound in a solid non-weeping formulation at 110° F.

2. The solid fabric softening composition according to claim 1, wherein the composition comprises between about 40 wt. % and about 70 wt. % of the quaternary ammonium compound.

3. The solid fabric softening composition according to claim 2 wherein said quaternary ammonium compound is a di-tallow quaternary ammonium compound.

4. The solid fabric softening composition according to claim 3 wherein said quaternary ammonium compound is methyl bis[ethyl (tallowate)]-2-hydroxyethyl ammonium methyl sulfate.

5. The solid fabric softening composition according to claim 1, wherein the composition comprises a fabric softening amount of a quaternary ammonium compound that has been stabilized with a combination of from about 0.1 wt. % and about 4 wt. % of medium to long chain carboxylic acid and from about 10% wt. % to about 60 wt. % of water soluble organic salt.

6. The solid fabric softener of claim 1, wherein the acidulant comprises a $C_4$-$C_6$ dicarboxylic acid blend and is present at a sufficient amount to reduce the amount of sloughing of a capsule during dispensing.

7. The solid fabric softener of claim 1 having a dispense rate with water at between 40° C. and 60° C. of greater than 10 g/min.

8. The solid fabric softener of claim 1 having a dispense rate with water at between 40° C. and 60° C. of greater than 15 g/min.

9. The solid fabric softener of claim 1 having a dispense rate with water at between 40° C. and 60° C. of greater than 20 g/min.

10. A solid fabric softening composition comprising;

from about 30 wt. % to about 70 wt. % of a quaternary ammonium compound;

from about 6 wt. % to about 60 wt. % of water soluble organic salt;

from about 0.1 wt. % to about 5 wt. % of a medium to long chain carboxylic acid;

from about 3.5 wt. % to about 15 wt. % of a silicone compound; and an acidulant that buffers at a pH between about 5 and about 6.5.

11. The solid fabric softening composition of claim 10 comprising:

from about 35 wt. % to about 65 wt. % of a quaternary ammonium compound;

from about 8 wt. % to about 50 wt. % of water soluble organic salt;

from about 0.5 wt. % to about 4.5 wt. % of a medium to long chain carboxylic acid.

12. The solid fabric softening composition of claim 10 wherein said solid composition does not weep at 100° F.

13. The solid fabric softening composition of claim 10 wherein said silicone compound is between about 2 wt. % and about 10 wt. % of the composition.

14. The solid fabric softening composition of claim 10 further comprising from about 5 wt. % to about 50 wt. % of an acidulant.

15. The solid fabric softening composition of claim 10 further comprising a solidification agent selected from the group consisting of solid polyethylene glycol, or a solid EO/PO block copolymer.

16. The solid fabric softening composition of claim 15 wherein said solidification agent is present in an amount of from about 0.5 wt. % to about 30 wt. % of said solid fabric softener composition.

17. A method for treating fabric in a wash wheel, the method comprising:

(a) allowing fabric containing free water to contact a fabric treatment composition inside a washer during a washing operation, wherein the fabric, treatment composition comprises: (i) fabric treatment agent comprising a fabric softener component comprising an quaternary ammonium compound, a medium to long chain carboxylic acid, a silicone compound present between about 3.5 wt. % and about 15 wt. %, an acidulant that buffers at a pH between about 5 and about 6.5, and a water soluble organic salt and;

(b) transferring the fabric treatment agent from the fabric treatment composition to the fabric as a result of solubilizing the fabric treatment agent with the free water in the fabric, and wherein the composition is provided in the form of a block wherein the block is constructed to provide release of an effective amount of the fabric treatment agent during the dispensing cycle.

18. A method according to claim 17, wherein fabric dried after the fabric treatment composition exhibit at least a panel softening test value of 3 on a 1-to-7 softening test as compared with the fabric dried outside of the presence of the fabric treatment composition.

19. A method according to claim 17, wherein fabric dried after the fabric treatment composition exhibit at least a panel softening test value of 4 on a 1-to-7 softening test as compared with the fabric dried outside of the presence of the fabric treatment composition.

20. A method according to claim 19, wherein the silicone is comprised of an aminosilicone, curable aminosilicones, dialkyl polysiloxanes, aminoalkyl siloxane or any combination thereof.

* * * * *